US005644321A

United States Patent [19]

Benham

[11] Patent Number: 5,644,321

[45] Date of Patent: Jul. 1, 1997

[54] MULTI-ELEMENT ANTENNA WITH TAPERED RESISTIVE LOADING IN EACH ELEMENT

[76] Inventor: Glynda O. Benham, P.O. Box 633, Sterling, Mass. 01564

[21] Appl. No.: 445,910

[22] Filed: May 22, 1995

Related U.S. Application Data

[63] Continuation of Ser. No. 3,408, Jan. 12, 1993, abandoned.

[51] Int. Cl.[6] ..... H01Q 9/44

[52] U.S. Cl. ..... 343/826; 343/731; 343/846

[58] Field of Search ..... 343/745, 826, 343/750, 873, 846, 731; H01Q 9/44, 9/02, 9/38

[56] References Cited

U.S. PATENT DOCUMENTS

| | | | |
|---|---|---|---|
| 2,978,703 | 4/1961 | Kuecken | 343/795 |
| 3,369,245 | 2/1968 | Rea | 343/795 |
| 3,673,044 | 6/1972 | Miller et al. | 156/433 |
| 3,721,990 | 3/1973 | Gibson et al. | 343/795 |
| 3,836,976 | 9/1974 | Monser et al. | 343/795 |
| 3,958,245 | 5/1976 | Cherenko et al. | 343/713 |
| 3,987,449 | 10/1976 | DeAngelis et al. | 343/713 |
| 4,038,662 | 7/1977 | Turner | 343/752 |
| 4,072,954 | 2/1978 | Comastri et al. | 343/713 |

(List continued on next page.)

FOREIGN PATENT DOCUMENTS

| | | | |
|---|---|---|---|
| 162009 | 8/1953 | Australia | 343/731 |
| 77148/81 | 5/1983 | Australia . | |
| 4307232 | 7/1993 | Germany | H01Q 1/32 |
| 0062902 | 4/1983 | Japan | 343/795 |
| 63-13402 | 7/1986 | Japan | H01Q 1/22 |
| 61-171202 | 8/1986 | Japan | H01Q 1/32 |
| 62-43905 | 2/1987 | Japan | H01Q 1/32 |
| 62-81101 | 4/1987 | Japan | H01Q 1/32 |
| 3-196703 | 12/1989 | Japan | H01Q 1/32 |
| 4-213903 | 12/1990 | Japan | H01Q 1/32 |
| 5-14028 | 6/1991 | Japan | H01Q 1/32 |
| 6-291530 | 10/1994 | Japan | H01Q 1/32 |

OTHER PUBLICATIONS

McMillan, "Log Spiral Design for Direction of Arrival Estimation," IEEE APS Symposium Proceedings, 1991.

Clapp, "A Resistively Loaded, Printed Circuit, Electrically Short Dipole Element for Wideband Array Applications", IEEE, May 1993, pp. 478–481.

Kanda, "Time Domain Sensors for Radiated Impulsive Measurements", IEEE Transactions on Antennas and Propagation, vol. AP–31, No. 3, May 1983, pp. 438–444.

Shen, "An Experimental Study of the Antenna with Nonreflecting Resistive Loading", IEEE Transactions on Antennas and Propagation, vol. AP15, No. 5, Sep. 1967, pp. 606–611.

Maloney, "Optimization of a Conical Antenna for Puulse Radiation: An Efficient Design Using Resistive Loading", IEEE Transactions on Antennas and Propagation, vol. 41, No. 7, Jul. 1993, pp. 940–947.

Torres et al., "Analysis and Design of a Resistively Coated Windshield Slot Antenna", Technical Report 312559–1, The Ohio State University, PPG Industries, Inc., Jun. 1991.

(List continued on next page.)

*Primary Examiner*—Michael C. Wimer

*Attorney, Agent, or Firm*—Fish & Richardson P.C.

[57] ABSTRACT

An antenna having efficient operation over a wide bandwidth, a low standing wave ratio and constant radiation characteristics over a wide bandwidth includes in one embodiment a set of four linear elements of substantially the same length. Each linear element has a base end and a distal end. The base ends are coupled together and adapted to be connected to a transmission line which is adapted to be connected to a communication device. The linear elements are disposed about the median axis of the antenna and diverge outward from their base ends relative to the median axis. Each linear element has continuous tapered resistive loading along its length. In another version of the invention each linear element is made up of a plurality of conducting elements interconnected by discrete resistive devices.

13 Claims, 7 Drawing Sheets

U.S. PATENT DOCUMENTS

| | | | |
|---|---|---|---|
| 4,114,163 | 9/1978 | Borowick | 343/795 |
| 4,141,011 | 2/1979 | Boaz | 343/713 |
| 4,145,694 | 3/1979 | Sletten | 343/727 |
| 4,163,236 | 7/1979 | Kaloi | 343/700 MS |
| 4,302,760 | 11/1981 | Laufer | 342/715 |
| 4,358,769 | 11/1982 | Tada et al. | 343/742 |
| 4,485,385 | 11/1984 | Ralston | 343/795 |
| 4,513,290 | 4/1985 | Lefevre et al. | 343/745 |
| 4,707,700 | 11/1987 | Nagy | 343/712 |
| 4,736,206 | 4/1988 | Sakurai et al. | 343/703 |
| 4,768,037 | 8/1988 | Inaba et al. | 343/713 |
| 4,791,426 | 12/1988 | Lindenmeier et al. | 343/713 |
| 4,825,220 | 4/1989 | Edward et al. | 343/795 |
| 4,827,274 | 5/1989 | Armbruster | 343/712 |
| 4,849,766 | 7/1989 | Inaba et al. | 343/713 |
| 4,860,019 | 8/1989 | Jiang et al. | 343/795 |
| 4,910,380 | 3/1990 | Reiss et al. | 219/203 |
| 4,931,764 | 6/1990 | Gaston | 338/185 |
| 5,012,255 | 4/1991 | Becker | 343/704 |
| 5,119,106 | 6/1992 | Murakami | 343/713 |
| 5,126,716 | 6/1992 | Munger | 338/306 |
| 5,173,713 | 12/1992 | Yves et al. | 343/826 |
| 5,285,048 | 2/1994 | Nakase | 219/203 |
| 5,353,039 | 10/1994 | Tsukada et al. | 343/713 |
| 5,355,144 | 10/1994 | Walton et al. | 343/713 |
| 5,363,114 | 11/1994 | Shoemaker | 343/828 |
| 5,365,242 | 11/1994 | Shiina | 343/713 |
| 5,406,295 | 4/1995 | Baranski et al. | 343/713 |

OTHER PUBLICATIONS

Torres et al., "Integral Equation Analysis of a Sheet Impedance Coated Window Slot Antenna", IEEE Transactions on Antennas and Propagation, vol. 42, No. 4, Apr. 1994, pp. 541–544.

Lindenmeier et al., "Multiple FM Window Antenna System for Scanning Diversity with an Integrated Processor", IEEE Transactions on Antennas and Propagation, 1990, pp. 1–6.

Austin et al., "Conformal On–glass Vehicle Antennas at VHF", IEE International Conference on Antennas and Propagation, England, 1993.

Austin, "Numerical Modelling and Design of Loaded Broadband Wire Antennas", University of Liverpool, U.K., pp. 125–129.

Rao, "Resistivity Tapered Wideband High Frequency Antennas for Tactical Communications", The Mitre Corporation.

Wu et al., "The Cylindrical Antenna with Nonreflecting–Resistive Loading," IEEE Transactions on Antennas and Propagation, vol. AP–13, pp. 369–373 (May 1965).

Kanda, "A Relatively Short Cylindrical Broadband Antenna with Tapered Resistive Loading for Picosecond Pulse Measurements," IEEE Transactions on Antennas and Propagation, vol. AP–26, No. 3, pp. 439–447 (May 1978).

Kanda, "The Time–Domain Characteristics of a Traveling–Wave Linear Antenna with Linear and Nonlinear Parallel Loads," IEEE Transactions on Antennas and Propagation vol. AP–28, No. 2, pp. 267–276 (Mar. 1980).

Rao et al., "Wideband HF Monopole Antennas with Tapered Resistivity Loading," presented at Milcom'90, 1990 IEEE Military Comm. Conf., Sep. 30–Oct. 3, 1990, Monterey, CA.

Clouston, "The Butterfly: A Broadband, Aerodynamic Antenna for Airborne Missile Scoring Using Impulse Radar," IEEE APS Symp. proc. 1991.

Rao, "Optimized Tapered Resistivity Profiles for Wideband HF Monopole Antenna," presented at 1991 IEEE Ant. & Prop. Soc. Intl. Symp., London, Ontario, Canada.

McMillan, "Log Spiral Design for Direction of Arrival Estimation," IEEE APS Symposium Proceedings, 1991.

Maloney et al., "Optimization of a Resistively Loaded Conical Antenna for Pulse Radiation," IEEE APS Symposium proceedings, Jul., 1992.

RADIATION CHARACTERISTICS

MULTI-ELEMENT ANTENNA WITH TAPERED RESISTIVE LOADING IN EACH ELEMENT

This is a continuation of application Ser. No. 08/003,408, filed Jan. 12, 1993, now abandoned.

BACKGROUND OF THE INVENTION

The present invention relates generally to antennas and more particularly to a multi-element antenna in which each one of the elements has tapered resistive loading over its length.

For commercial and military reasons, there exists a need for an antenna that has a low standing wave ratio and has uniform radiation pattern characteristics over a wide bandwidth.

Conventional monopole and dipole antennas are two very well known and commonly used antennas. However, such antennas have many shortcomings. First, these antennas are very narrow band, thereby limiting the frequency range of operation. Second, these antennas experience large variations in their impedance characteristies when operated over large frequency bands due to multiple resonances within the antenna. Third, these antennas experience a degradation in the radiation pattern characteristics over large frequency bands. The degradation manifests itself as multiple lobes and nulls in the radiation pattern characteristics. Fourth, these antennas require complex matching circuits to obtain an instantaneous broadband system.

Broader band characteristics have been obtained with conventional monopoles and dipoles by increasing the diameter to length ratio; however, the bandwidth has still been limited.

The concept of using tapered resistive loading to improve the bandwidth of conventional monopoles and dipoles is well known in the art. Articles describing this concept include Cylindrical Antenna with Nonreflecting -Resistive Loading, IEEE Transactions On Antennas And Propagation, Vol. AP-13, No. 3, pp. 369–373, May 1965, T. T. Wu and R. W. P. King. It should be understood that the Wu-King approach is merely illustrative of one approach that may be used to make a loading profile. Other pertinent articles include Optimized Tapered Resistivity Profiles For Wideband HF Monopole Antenna, presented at the 1991 IEEE Antenna And Propagation Society International Symposium, London, Ontario Canada, pp. 1–4, B. Rama Rao; Wideband HF Monopole Antennas With Tapered Resistivity Loading, presented at MILCOM '90, 1990 IEEE Military Communications Conference, Monterey, Calif., Sep. 30–Oct. 3, 1990, pp. 1223–1227, B. Rama Rao and P. S. Debroux; The Time-Domain Characteristics Of A Traveling-Wave Linear Antenna With Linear And Non-Linear Parallel Load, IEEE Transactions On Antennas And Propagation, Vol. AP-28, No 2, March 1980, pp. 267–276, M. Kanda; and A Relatively Short Cylindrical Broadband Antenna With Tapered Resistive Loading for Picosecond Pulse Measurements, IEEE Transactions On Antennas And Propagation, Vol. AP 26, No. 3, May 1978, pp. 439–447, M. Kanda.

Articles pertaining to other types of resistively loaded antennas include, The Butterfly: A Broadband Aerodynamic Antenna For Airborne Missile Scoring Using Impulse Radar, IEEE APS Symposium Proceedings 1991, pp. 715–718 E. N. Clouston. A resistive loaded antenna having a butterfly configuration is disclosed. In an article Optimization Of A Resistively Loaded Conical Antenna For Pulse Radiation, IEEE APS Symposium Proceedings, July 1992, pp. 1968–1972, J. G. Maloney and G. S. Smith there is described a solid cone shaped antenna which is partially metallic and resistively loaded over the remainder of its surface.

In U.S. Pat. No. 5,173,713 to F. Yues et al there is disclosed a three element inverted conical monopole antenna in which each element includes a series inductance and resistance. In U.S. Pat. No. 4,302,760 to S. Laufer there is disclosed a wideband vertical doublet antenna.

It is an object of this invention to provide a new and improved antenna.

It is another object of this invention to provide an antenna that operates over a wide bandwidth.

It is still another object of this invention to provide an antenna that has a low standing wave ratio.

It is yet another object of this invention to provide an antenna that has constant radiation characteristics over a wide bandwidth.

It is a further object of this invention to provide an antenna that is lightweight.

SUMMARY OF THE INVENTION

An antenna having a low standing wave ratio and constant radiation characteristics over a wide bandwidth constructed according to the teachings of this invention includes a plurality of linear elements of substantially the same length, each linear element having a base end and a distal end, the base ends being adapted to be connected to a transmission line which is adapted to be connected to a communications device, the linear elements being disposed about the median axis of the antenna and diverging outward from their base ends relative to the median axis, each linear element being resistively loaded in a tapered manner along its length. The tapered resistive loading of each linear element is achieved using either a continuous layer of resistive material or a plurality of discrete resistance devices located at predetermined locations along its length, the value of the resistance in both cases varying from the base end of the linear element to the distal end, according to a predetermined loading profile.

Various features and advantages will appear from the description to follow. In the description, reference is made to the accompanying drawings which forms a part thereof, and in which is shown by way of illustration, specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is therefore, not to be taken in a limitive sense, and the scope of the present invention is best defined by the appended claims.

BRIEF DESCRIPTION OF THE DRAWINGS

In the drawings wherein like reference numerals represent like parts.

DETAILED DESCRIPTION OF PREFERRED EMBODIMENTS

The present invention is directed to an antenna that is lightweight, broadband and efficient. The antenna may be used as a broadband field monitoring sensor, in mobile communications, as a tactical antenna, as a spread spectrum communications antenna, in fast frequency hopping systems and as an HF, VHF or UHF communications antenna.

The present invention is realized by providing an antenna that is made up of at least two linear elements, with each element having tapered resistive loading. As will hereinafter become apparent, the invention applies to any multi-element antenna. As used herein, the term "multi-element antenna" refers to an antenna having at least two diverging linear elements whose base ends are adapted to be coupled to a transmission line which is adapted to be coupled to a radioelectric communications device.

Figure 1:
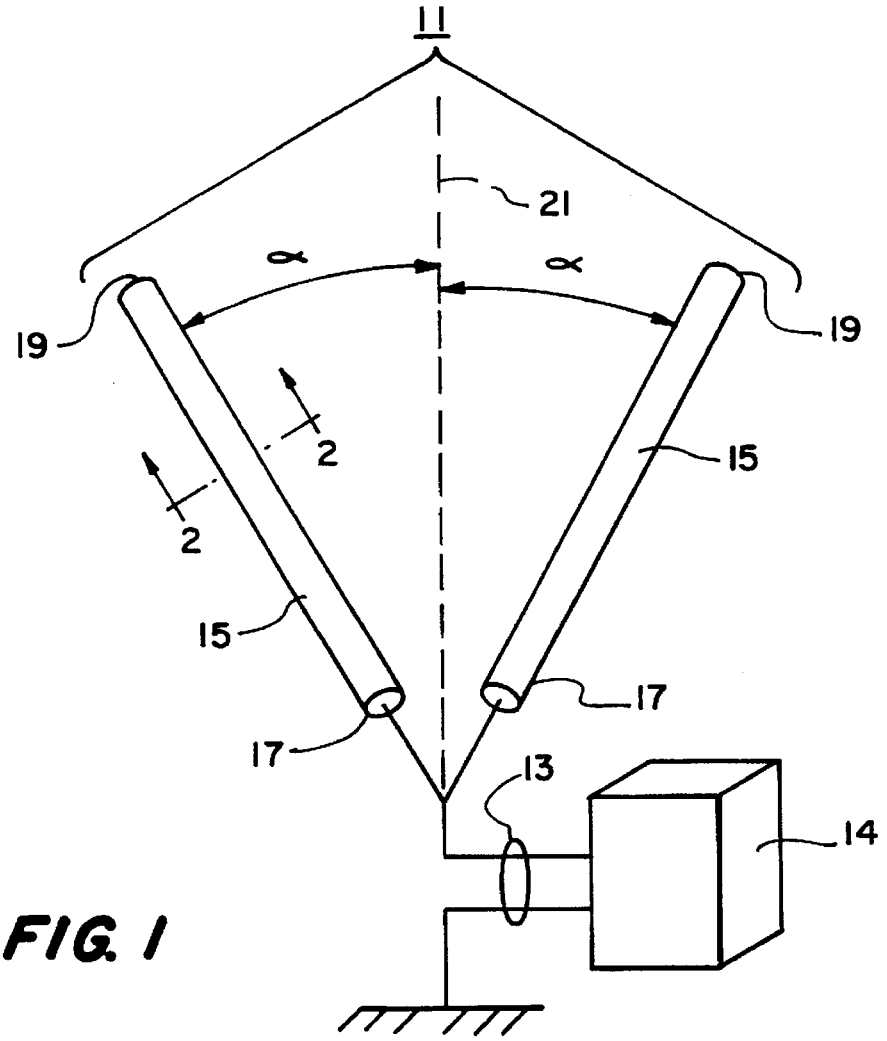
FIG. 1 is a pictorial representation of one type of antenna constructed according to this invention, the antenna being coupled to ground through a communication device.

Referring now to the drawings there is shown in FIG. 1 a pictorial representation of one embodiment of an antenna constructed according to this invention, the antenna being identified by reference numeral 11. In FIG. 1, antenna 11 is shown connected by an electrical transmission line 13 to a radioelectric communications device 14. Radioelectric communications device 14 may be a transmitter and/or a receiver.

Antenna 11 comprises two linear elements 15 of substantially the same length and which conduct electricity. Each linear element 15 includes a base end 17 and a distal end 19. The base ends 17 of elements 15 are connected to electrical transmission line 13. The two linear elements 15 diverge outward from the base ends 17, each at an angle $\alpha$ with the median axis 21 of antenna 11. $\alpha$ may be any angle greater than zero degrees or less than 90 degrees, but preferably in the range 20–60 degrees.

Each linear element 15 is provided with tapered resistive loading over its length.

Figure 2:
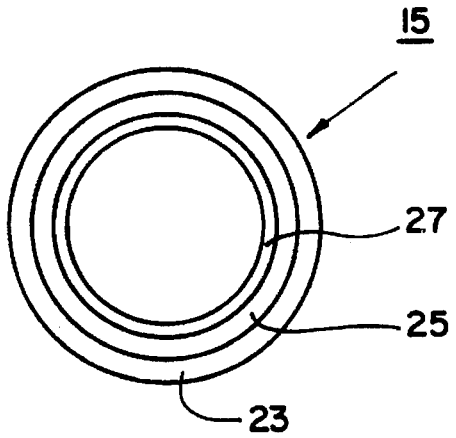
FIG. 2 is a cross-section view of one of the linear elements in the antenna shown in FIG. 1 the cross-section view being taken along lines 2—2 in FIG. 1.

Referring now to FIG. 2 there is shown a cross-section of one of the linear elements 15 in antenna 11, the cross-section being taken along lines 2—2 in FIG. 1. Linear element 15 includes an elongated cylindrically shaped tube 23 of electrically insulating material. An electrically insulative film 25 is fixed to the inner surface of tube 23 and a variable thickness layer of metallic material 27 is formed on the inner surface of film 25. The thickness of variable thickness layer 27 at any location along the length of linear element 15 is determined using a precalculated loading profile. Film 25 may be, for example a 10 mil. thick polyester film bonded to tube 23 and metallic material 27 may be a layer of chromium which is RF sputtered onto film 25. Instead of being attached to the inner surface of tube 23, film 25 could be attached to the outer surface of tube 23 and metallic material 27 deposited to the outer surface of film 25. Also, film 25 could be eliminated and resistive layer 27 deposited directly to tube 23.

The loading profile for determining the thickness of layer 27 may be obtained, for example, using the approach described in the previously noted article by T. T. Wu and R. W. P. King.

In the Wu-King approach, given the antenna length and diameter, the value of psi, the profile parameter is determined as a function of frequency. The impedance per unit length along the antenna, zi (z), for an outward traveling wave to exist, is a function of psi and the distance measured along the antenna and is given by:

$$zi(z)=60\ \mathrm{psi}/(h-|z|)$$

where z is the distance from the feed point and h is the half length of a dipole element. Psi is a complex number whose magnitude or real part is used to determine a purely resistive loading profile, and whose complex value is used to determine a resistive/reactive profile. Its value may vary over the frequency band of interest depending on the ratio of the upper to lower operating frequencies. The resulting profile, and hence performance, thus depends on the frequency at which psi is chosen. It would appear that optimizing psi at a higher frequency in the band of interest improves efficiency and reduces the VSWR at the low end of the band.

Figure 3:
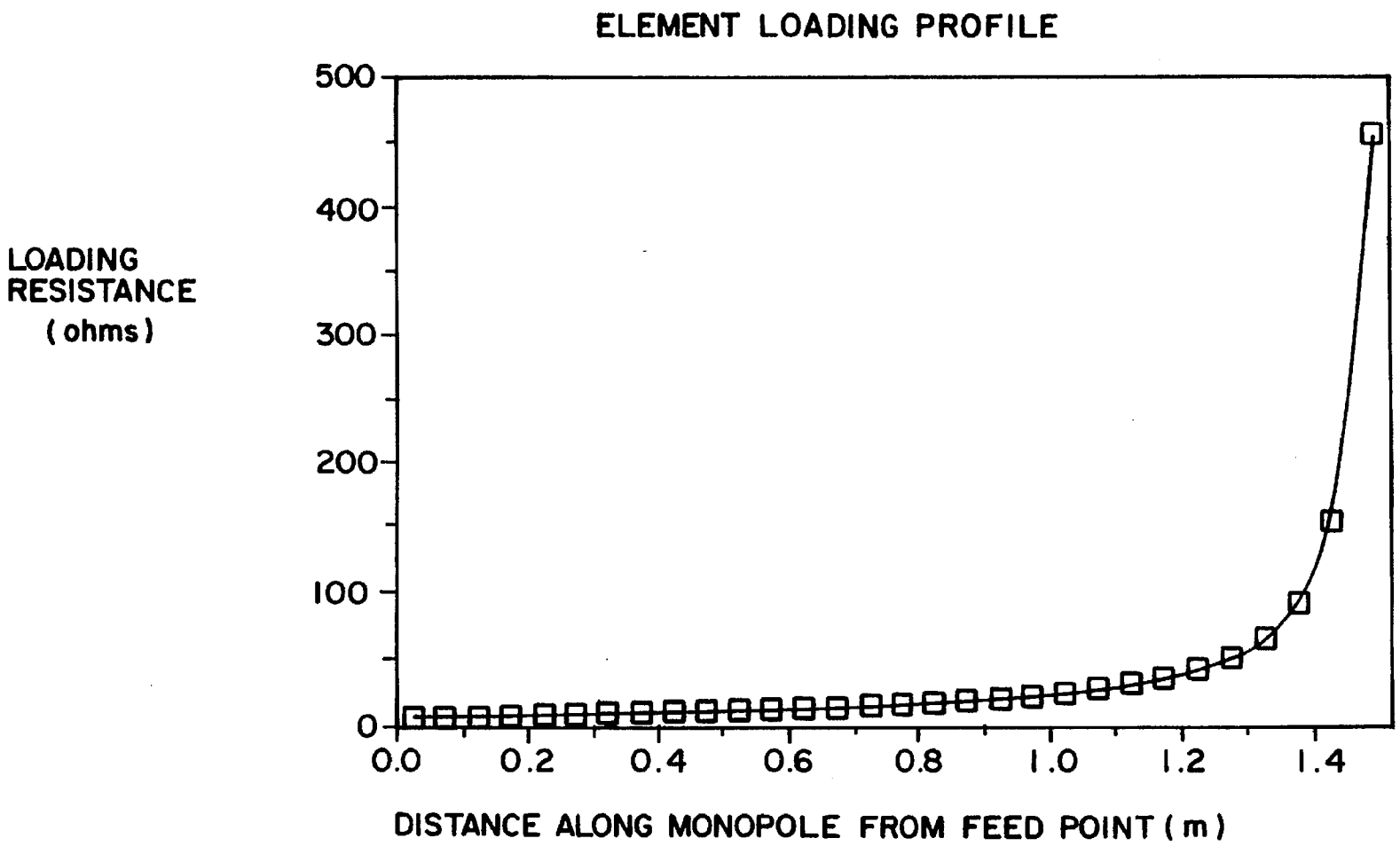
FIG. 3 is a graph of a typical element loading profile useful in the construction of the linear elements according to this invention.

A typical element loading profile is shown in FIG. 3. As an example, tube 23 may be 50 mils thick and made from Spectra 1000 and E glass reinforcement in an epoxy matrix.

Figure 4:
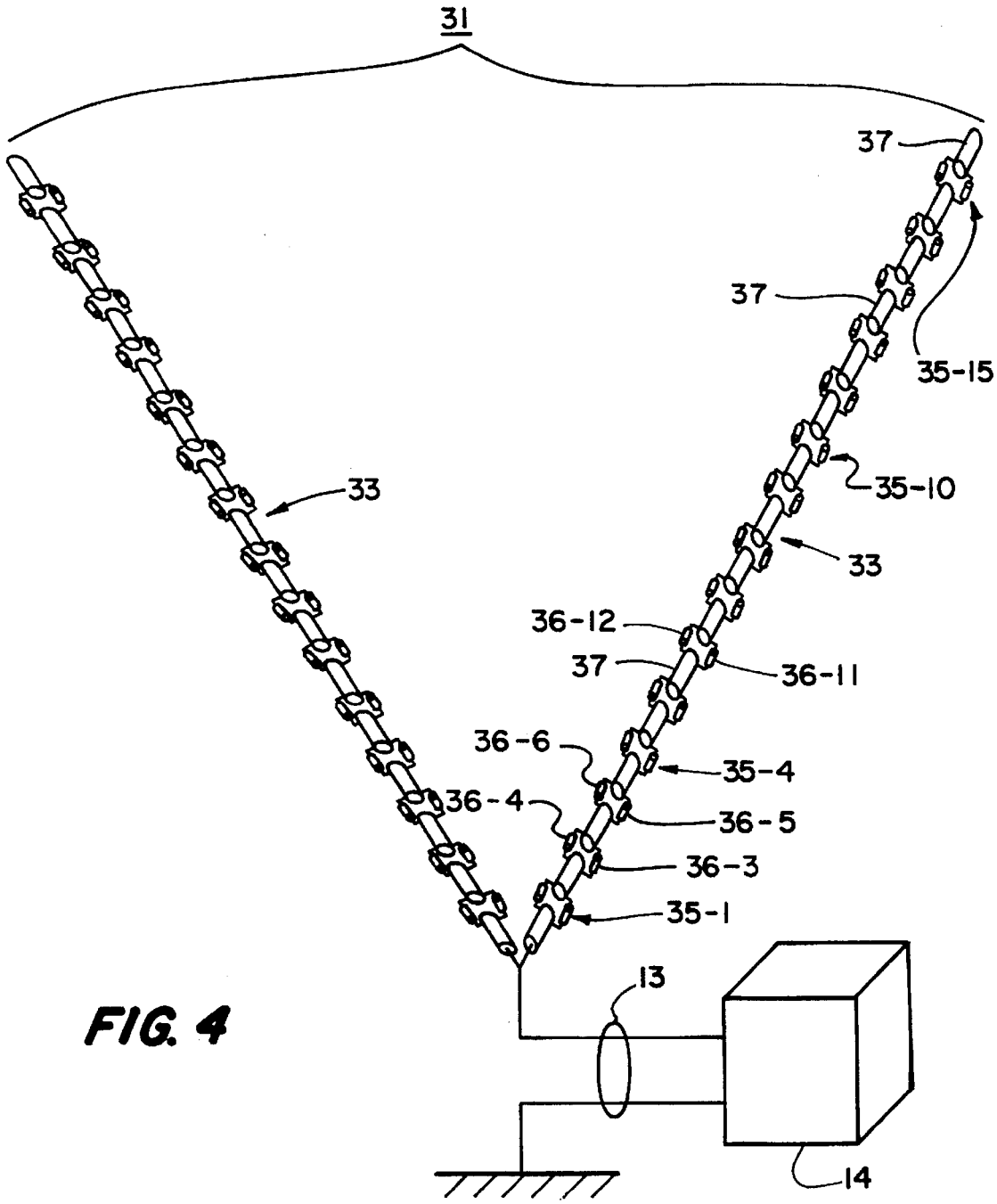
FIG. 4 is a pictorial representation of a modification of the antenna shown in FIG. 1.

Referring now to FIG. 4, there is shown a pictorial representation of a modification of the antenna shown in FIG. 1, the modification being identified by reference numeral 31.

Antenna 31 includes a pair of linear elements 33 which are each also resistively loaded in a tapered fashion; however, the tapered resistive loading is achieved in a different manner than in the FIG. 1 embodiment. More specifically, in antenna 31 each linear element 33 includes a plurality of resistive devices 35–1 through 35–15, arranged in a row and spaced apart from one another the number of resistive devices 35 shown being for illustrative purposes only and the particular value of each resistive device 35 being according to a predetermined loading profile. Each resistive device 35 includes one or more resistors 36, the number and size of the resistors depending on the desired resistance for each resistive device 35. In the drawings each resistive device 35 is shown as comprising a pair of resistors 36. Resistive devices 35 are electrically coupled together by conducting (metallic) elements 37 separated by air. Instead of being separated by air, conducting elements 37 could be separated by a dielectric material.

Figure 5:
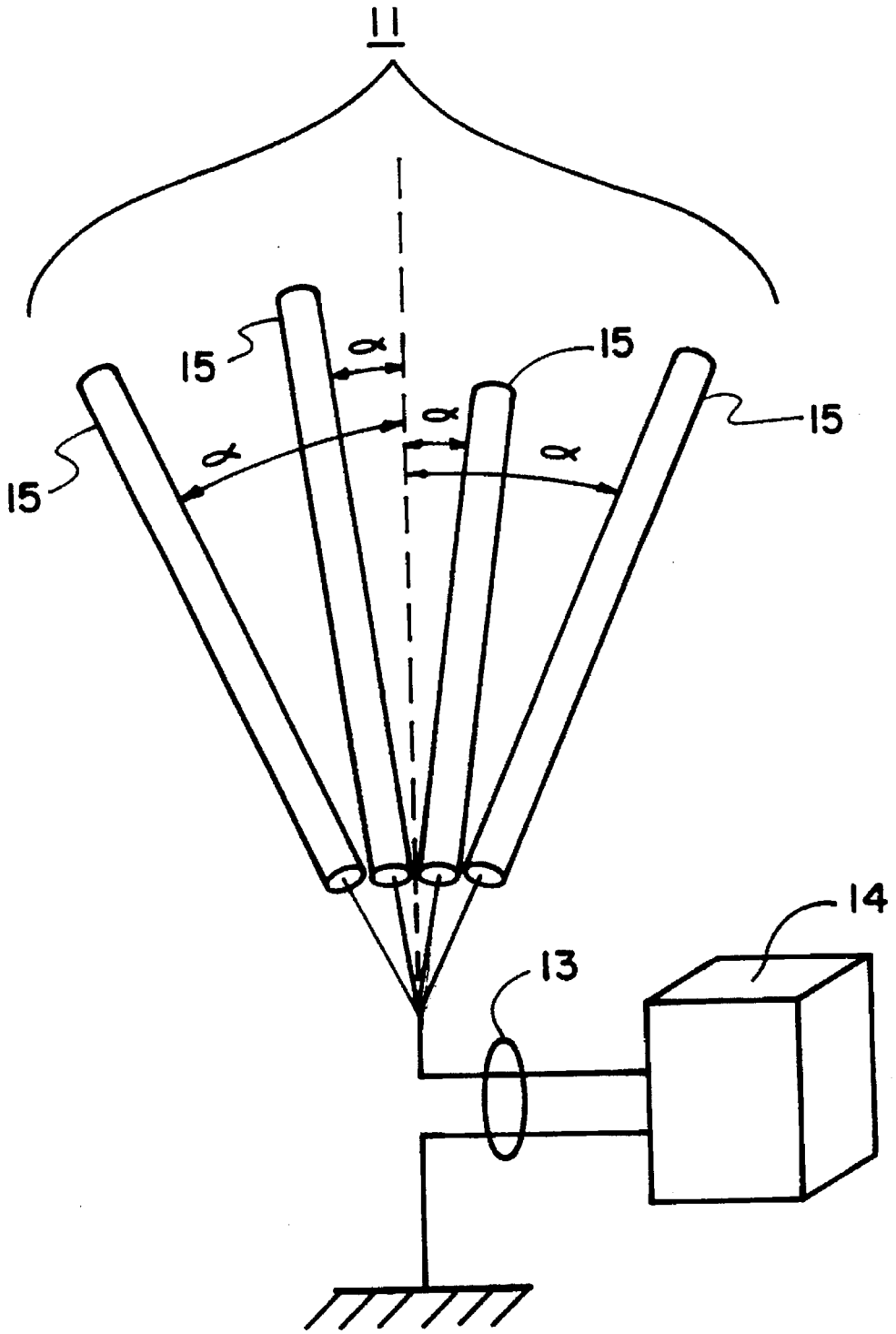
FIG. 5 is a pictorial representation of another type of antenna constructed according to this invention.

Referring now to FIG. 5 there is shown a perspective view of another embodiment of an antenna constructed according to this invention, the antenna being identified by reference numeral 41. Antenna 41 differs from antenna 11 in that it has four linear elements 15 rather than two linear elements 15. The angle each linear element makes with the median axis is the same as the FIG. 1 embodiment. In a variation of the FIG. 5 embodiment, linear elements 15 are replaced with linear elements 33.

Figure 6:
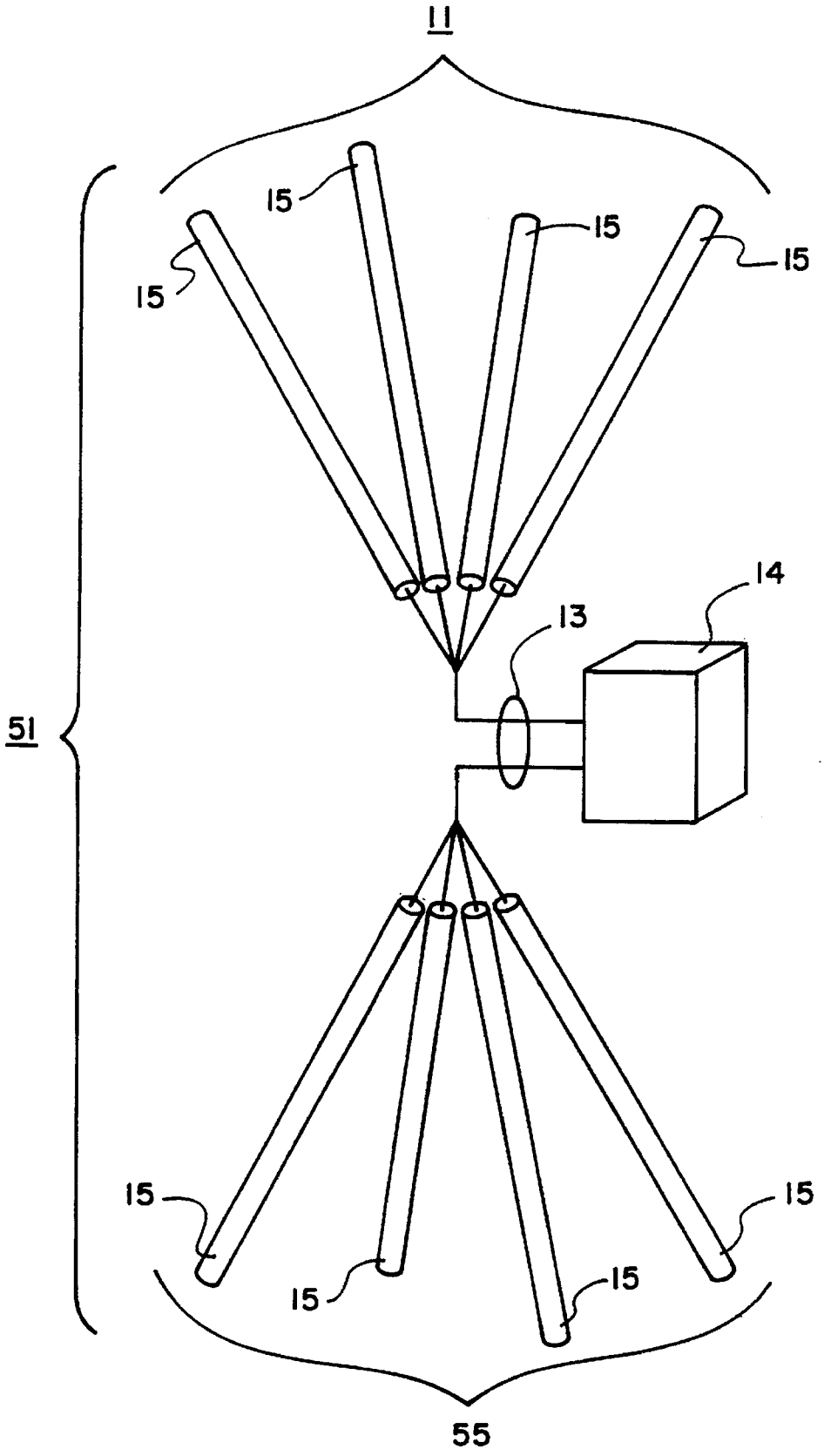
FIG. 6 is a pictorial representation of another type of antenna constructed according to this invention.

Referring now to FIG. 6 there is shown a perspective view of another embodiment of an antenna constructed according to this invention, the antenna being identified by reference numeral 51. Antenna 51 differs from antenna 41 in that it has two groups 53 and 55 of linear elements 15, the two groups being arranged in a dipole configuration.

The number of linear elements 15 in each group is at least two, the numbers shown being for illustrative purposes only. The angle α each linear element makes with the median axis is the same as the FIG. 1 embodiment.

In a variation of the FIG. 6 embodiment; linear elements 15 are replaced with linear elements 33.

Figure 7:
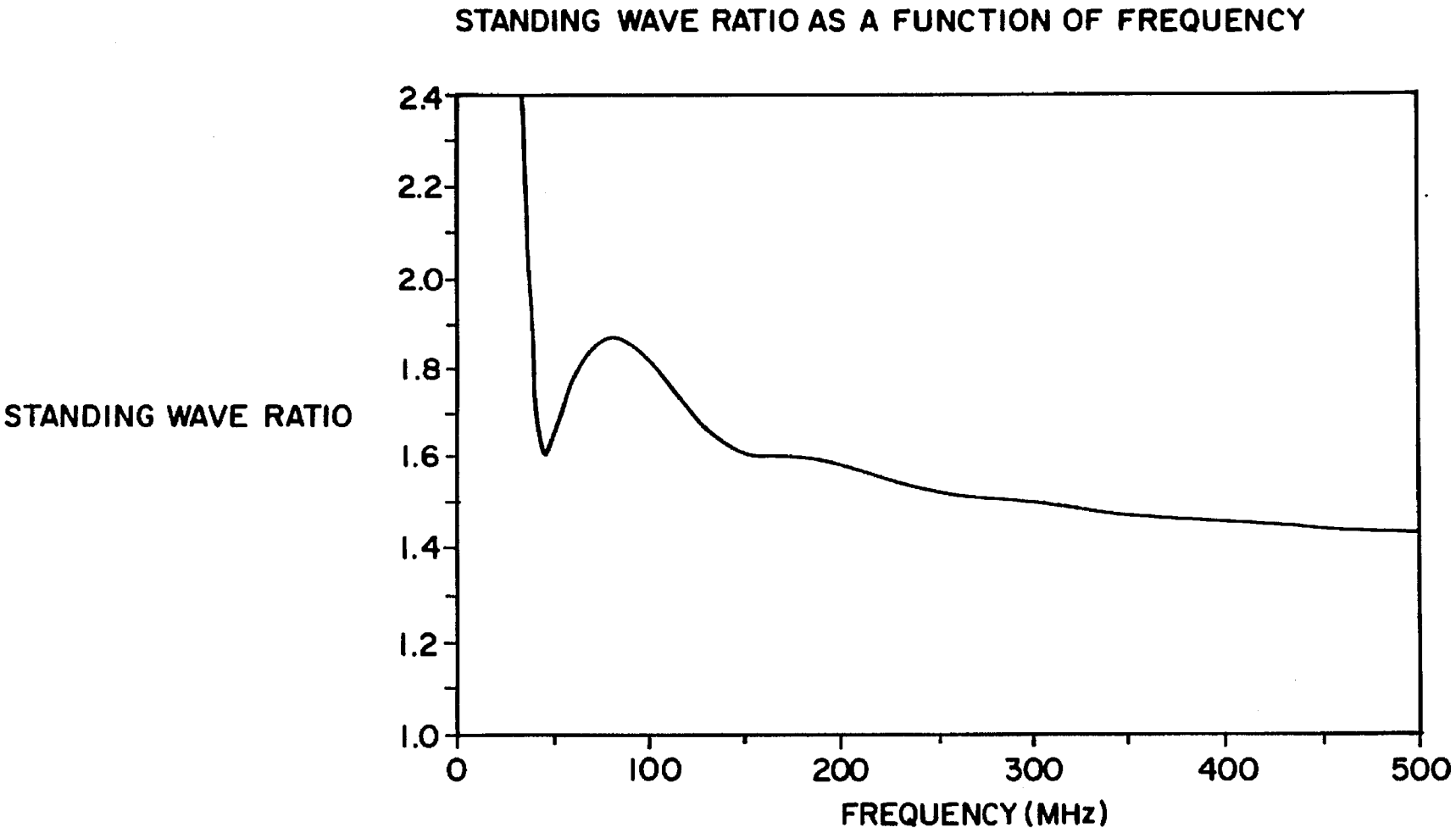
FIG. 7 is a graph of the standing wave ratio with respect to a 50 ohm characteristic impedance as a function of frequency for the antenna shown in FIG. 5, each linear element having a length of 1½ meters, a diameter of 5 cm and a cone angle of 30 degrees.
Figure 8:
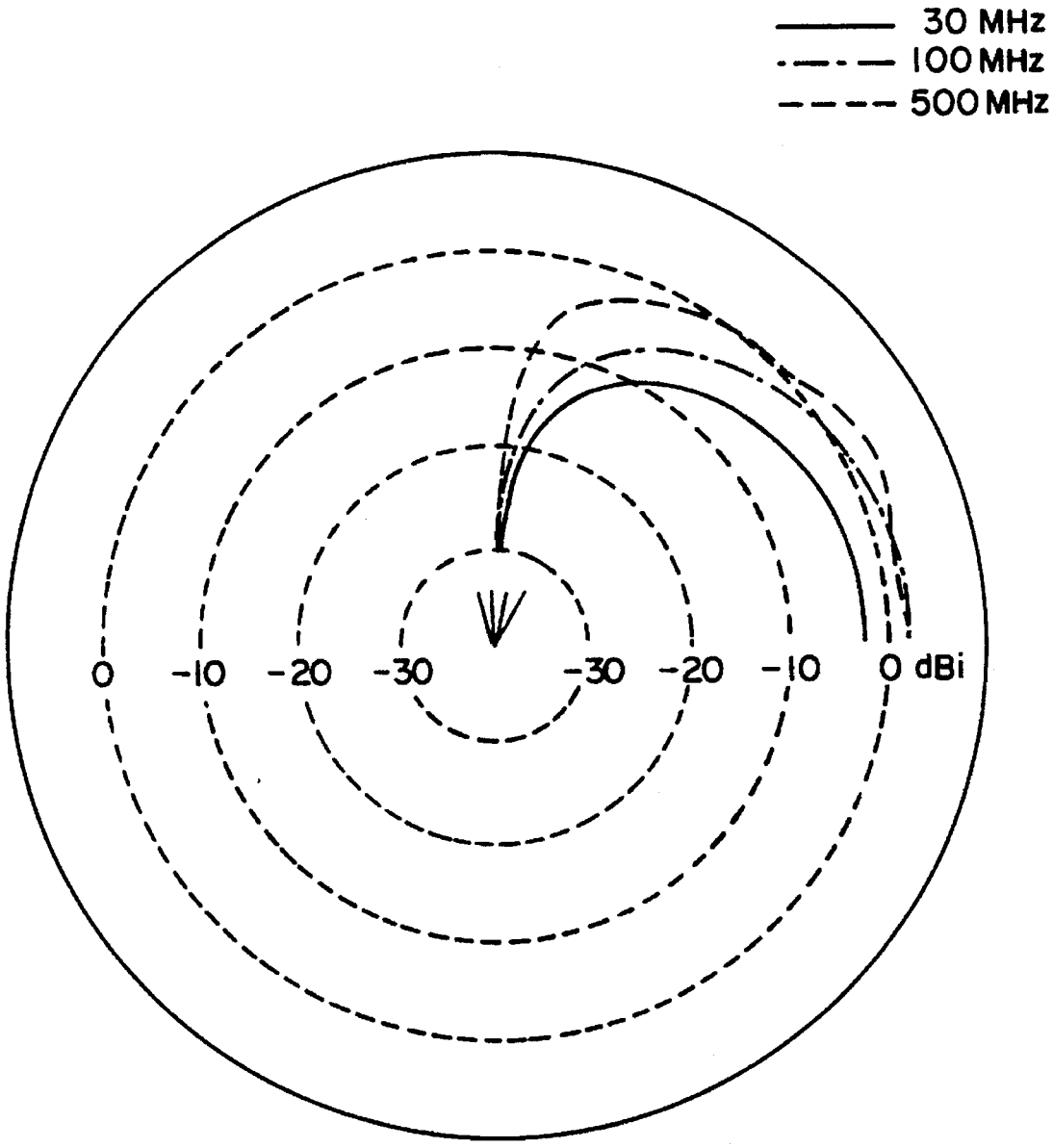
FIG. 8 is a graph showing radiation characteristics for the antenna shown in FIG. 5.

In FIG. 7 there is shown a graph of the standing wave ratio with respect to a 50 ohm characteristic impedance as a function of frequency for an antenna constructed according to the FIG. 5 embodiment wherein each linear element is 1.5 meters long and has a diameter of 5 cm and wherein the angle is about 30 degrees. The radiation characteristics for an antenna so constructed are as shown in FIG. 8.

The embodiments of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. An antenna comprising linear elements each having a base end and a distal end, the base ends of said linear elements being connected directly together and directly to a conductor of a transmission line, said linear elements being disposed about a median axis of said antenna and diverging outward from their base ends relative to said median axis, each of said linear elements having a resistance that varies non-linearly and essentially continuously along its length, said linear elements having essentially the same non-linearly and essentially continuously varying tapered resistive loading along their lengths and essentially the same impedances, and a ground plane lying in a plane essentially normal to the median axis of said antenna, the ground plane being connected to another conductor of said transmission line so that said linear elements are fed in a common mode relative to the ground plane, the linear elements together effecting a low standing wave ratio, a wide bandwidth achieved other than by differences in the impedances of the linear elements, and an omnidirectional radiation pattern.

2. The antenna of claim 1 and wherein there are two of said linear elements.

3. The antenna of claim 1 and wherein there are at least three of said linear elements.

4. The antenna of claim 1 and wherein there are four of said linear elements.

5. The antenna of claim 1 wherein each of the linear elements comprises a continuous layer of resistive material of variable thickness.

6. The antenna of claim 1 wherein each of the linear elements comprises a plurality of discrete resistors at different locations along the length of the linear element and sized to provide for said resistance that varies non-linearly and essentially continuously.

7. The antenna of claim 1 wherein each of the linear elements comprises a plurality of resistive devices arranged in a row and spaced apart from one another and sized to provide for said resistance that varies non-linearly and essentially continuously.

8. The antenna of claim 7 wherein each of said resistive devices comprises at least one resistor.

9. The antenna of claim 8 wherein each of said resistive devices comprises at least two resistors.

10. The antenna of claim 5 wherein the continuous layer of resistive material comprises chromium.

11. The antenna of claim 1 wherein each of said linear elements has a length of about 1.5 meters.

12. The antenna of claim 1 wherein said antenna is useful in a frequency range which includes about 50 MHZ.

13. The antenna of claim 1 wherein said antenna is sized to correspond to a quarter wavelength long at a frequency of 50 MHZ.

* * * * *